United States Patent [19]

Scalf

[11] Patent Number: 4,802,782

[45] Date of Patent: Feb. 7, 1989

[54] CLEANING INSTRUMENT FOR CARPETS AND LIKE SURFACES

[76] Inventor: James Scalf, R.I. Box 525 #85A, Marathon, Fla. 33050

[21] Appl. No.: 133,840

[22] Filed: Dec. 16, 1987

[51] Int. Cl.[4] ..... A47L 13/12; A47L 13/26

[52] U.S. Cl. ..... 401/138; 15/114; 401/39; 401/140

[58] Field of Search ..... 401/138, 139, 137, 140, 401/27, 25, 26, 23, 24, 39; 15/114

[56] References Cited

U.S. PATENT DOCUMENTS

| | | | |
|---|---|---|---|
| 798,532 | 8/1905 | Sanders | 401/25 X |
| 1,059,427 | 4/1913 | Barnwell | 401/137 X |
| 1,818,917 | 8/1931 | Wolf | 401/25 X |

FOREIGN PATENT DOCUMENTS

| | | | |
|---|---|---|---|
| 495887 | 6/1950 | Belgium | 401/27 |
| 459921 | 9/1949 | Canada | 401/138 |
| 667653 | 10/1938 | Fed. Rep. of Germany | 401/23 |
| 106740 | 9/1924 | Switzerland | 401/27 |
| 451707 | 8/1936 | United Kingdom | 401/27 |
| 634521 | 3/1950 | United Kingdom | 401/138 |

*Primary Examiner*—Steven A. Bratlie

*Attorney, Agent, or Firm*—John Cyril Malloy

[57] ABSTRACT

A cleaning tool or instrument designed generally to clean carpets and like surfaces and more specifically designed to remove spots, stains, etc. therefrom. A first agitating rake-like head is attached to an elongated base and extends outwardly into an operative position from one side of the base. A second liquid absorbing or blotting structure is secured to the base at the corresponding end as the agitating member but extending outwardly from a different side thereof wherein the base, through manipulation of the handle means, is positionable so as to apply either the agitating structure or the blotting structure to the carpet for purposes of respectively working the surface in an agitating manner and blotting or at least partially absorbing absorbing any cleaning fluid applied to the carpet for purposes of removing the spot or stain.

10 Claims, 1 Drawing Sheet

CLEANING INSTRUMENT FOR CARPETS AND LIKE SURFACES

BACKGROUND OF THE INVENTION

1. Field of the Invention

An instrument or tool generally designed to clean carpets or like surfaces more specifically intended to remove spots or stains therefrom in a localized area and including a plurality of working heads each structured and disposed to perform a different function to accomplish the cleaning process.

2. Description of the Prior Art

Numerous instruments, tools and equipment are available which are specifically designed to aid the user in cleaning of carpets, rugs, and like surfaces. Such prior art devices demonstrate a wide variance in design and structural configurations and accordingly are intended frequently to overcome a specific problem recognized in the rug or carpet cleaning industry. Compound tools are also known wherein a device is provided typically to have a broom as well as a liquid dispensing component. While it is assumed that such known and prior art devices are applicable for their intended function, there is still a recognized need in the carpet cleaning industry for a device specifically structured and designed to be capable of removing spots or stains as versus cleaning the entire carpet or rug surface and further, wherein such a preferred instrument would have the versatility to be used as a pre-conditioning tool and pre-spotter when used with other more conventional and elaborate devices such as motorized cleaning machines.

The following U.S. patents are representative of prior art structures generally designed for the cleaning and care of carpets, rugs and like floor surfaces.

Sanders, U.S. Pat. Nos. 798,532; Bode, 828,705; and Corbett, 1,093,114 all relate to scrub brush type structures having elongated handles or bases and designed to primarily clean hard surfaces as versus carpets or rugs. Further, each of these structures are characterized by having a self-carrying or attached supply of water or like cleaning liquid to be applied simultaneously to brushing. These patents, however, demonstrate prior art devices which are designed to primarily clean hard surface floor areas rather than carpets, rugs, etc. and are not specifically structured or designed to have the capabilities of removing spots, stains, or localized areas of the carpet where concentrated dirt, etc. is evident.

Reed, U.S. Pat. Nos. 2,609,557; Trevena, 1,685,731; and Lowe, 2,228,574 relate respectively to a broom structure, mop structure and applicator for cleaning floor surfaces wherein each of the prior art structures disclosed in these references also include means of dispensing a liquid onto the areas being concurrently swept, mopped, etc.

The patent to Rosen et al, U.S. Pat. No. 2,243,607 is somewhat similar to the above-noted prior art structures in disclosing a brush-type, elongated hand-maniputable instrument specifically designed to treat carpeting or rugs as versus hard surface floor areas.

The patent to Kenny et al, U.S. Pat. No. 3,094,152 discloses a liquid dispensing device for floor machines which are motorized and electrically powered and commonly known as polishing machines.

While the structures disclosed in the above set forth patents are operable for their intended function none are specifically designed to remove spots, stains, or concentrated dirt or like material from an area of a soft surface carpet, rug, etc. The structure of a preferred device has sufficient versatility to allow it to be used as a pre-conditioner or pre-spotter for more conventional equipment designed to clean the entire carpet area. Accordingly, there is still a need in the rug or carpet cleaning industry for a tool specifically designed to overcome the problems recognized in the art and accomplish the purpose of specialized cleaning as set forth above.

SUMMARY OF THE INVENTION

The present invention relates to a tool specifically designed to clean and remove stains, spots, or like concentrated areas of dirt from a carpet, rug or like normally soft material surface by means of agitating the localized area applying a cleaning liquid thereto and then absorbing or blotting up excess liquid as well as the dirt or staining material from the carpet surface. It should be emphasized that the structure of the present invention to be described in greater detail hereinafter is also structured to be sufficiently versatile to allow it to function as a pre-conditioner or pre-spotting tool when a larger mechanized machine is used for the overall cleaning of the carpet or rug surface.

More specifically, the tool assembly of the present invention comprises an elongated base having a handle means formed at one end thereof. The handle means is specifically structured to generally manipulate the elongated base as well as allow it to be disposed in a somewhat reversed orientation in order to properly position one of a plurality of working components on the opposite end of the base into an operative working position relative to the surface being cleaned. More specifically, the tool assembly of the present invention further comprises an agitating means secured to an opposite end of the elongated base relative to the handle means. The agitating means may preferably be in the form of a rake-like structure having a plurality of tines made of sufficiently rigid material to adequately "work" the soft surface of the carpet or rug being cleaned. This working accomplishes a loosening of the material causing the spot or stain as well as a thorough distribution and exposure of dispersed cleaning liquid over the localized area of the spot or stain.

In addition to the agitating means, the subject tool assembly further comprises a cleaning means also mounted on the opposite end of the base relative to the handle means and substantially adjacent to the agitating means. The cleaning means extends outwardly from the base at one side thereof in a direction clearly variant from the direction of the outer projection of the agitating means. Accordingly, when it is desired to use the agitating means, the handle means is manipulated so as to properly position the base and the agitating means in its operative position. After use of the agitating means, the base may be effectively "reversely oriented" such that the outwardly extending cleaning means is then positioned into its respective operative position and into engagement with the surface of the carpet or rug being cleaned.

Specific structural features of the cleaning means include a cleaning head having an outer absorbent material or sheath or cover over an exposed surface thereof. The sheath or cover is cooperatively disposed in overlying relation to a supporting surface of the cleaning head so as to allow maximum exposure to the surface being cleaned and any excess cleaning fluid thereon.

The absorbency of the sheath or covering material serves to remove the excess moisture from the surface as well as any collected dirt or like material causing the stain. Another feature associated with the cleaning head is its movable or pivotal connection to the base. This movable connection allows a somewhat rocking, reciprocating movement of the curvilinear support surface and absorbent covering material mounted thereon into contact with the surface of the carpet to effect a blotting action and accomplish maximum absorbence of the excess leaning liquid previously applied to the localized stain area on the surface being cleaned.

In a preferred embodiment of the present invention to be described in greater detail hereinafter, a liquid dispensing means is attached directly to the base and includes a dispensing head disposed adjacent to the opposite end to which the agitating means is attached. The dispensing head communicates with a self-contained supply of chemicals such as cleaning liquid or the like. A trigger or release mechanism is located substantially adjacent the one end of the elongated base and adjacent to the handle means. Accordingly, manipulation of the release or trigger means will serve to activate a release of the liquid within the liquid supply of the dispensing means allowing it to be dispersed from the dispensing head onto the preferred localized area of the stain or spot on the carpet surface. Agitation through movement of the agitation means or rake serves to equally spread the cleaning liquid throughout the stained area and effectively "work" the area of the stain with the cleaning liquid to accomplish removal and cleaning thereof. Once this is accomplished, the base may be oriented into the above noted reverse orientation so as to operatively position the cleaning head of the cleaning means as well as the absorbent sheath or cover thereon. This then accomplishes an absorbency and removal of the excess cleaning liquid and any dirt or debris contained therein primarily through the accomplishment of a rocking and "blotting" action of the cleaning head and the support surface carrying the absorbent sheath material.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
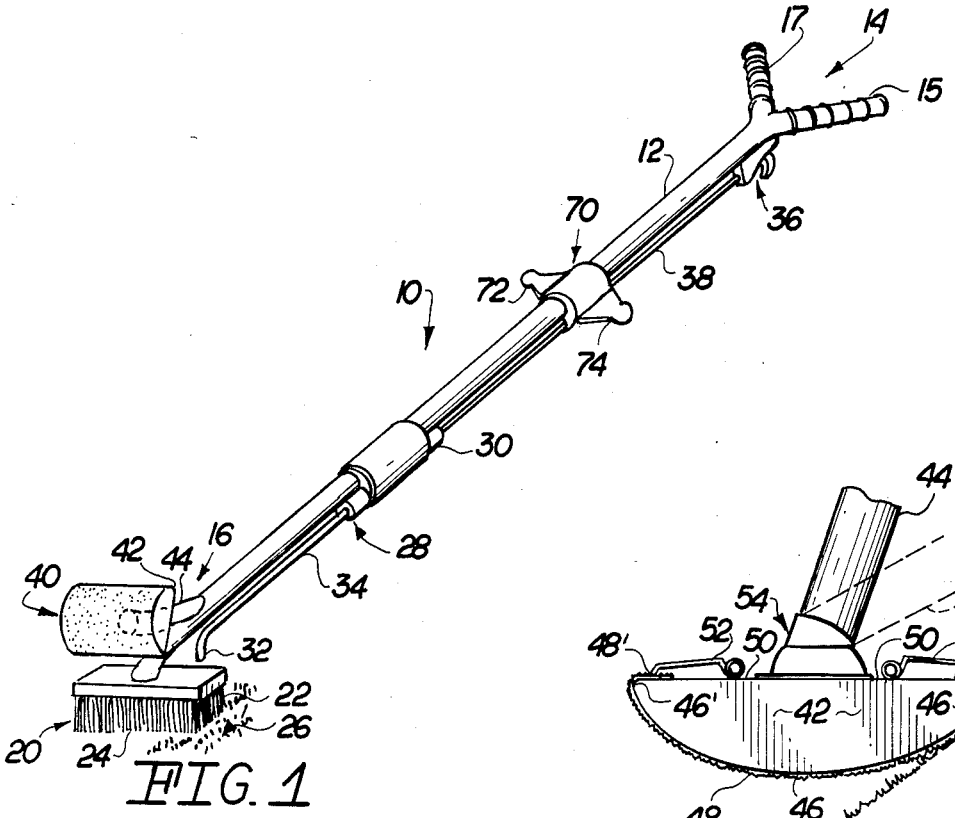
FIG. 1 is a perspective view of the cleaning tool assembly of the present invention.

As shown in FIG. 1, the tool assembly is generally indicated as 10 and includes an elongated body 12 having a handle means generally indicated as 14 secured to one end. the working components or structures of the subject tool assembly are secured to the opposite end 16 of the base 12 as generally indicated.

More specifically, the working components secured to opposite end 16 of base 12 comprise an agitating means generally indicated as 20 having a structural configuration which may be generally defined as a rake-like structure including a plurality of spaced apart depending tines 22 supported on an elongated support platform 24. The agitating means 20, as can be seen in FIG. 1, extends substantially outwardly from the length or longitudinal axis of the base 12 so as to be disposable into an operative position relative to the carpet, rug or like surface 26 being cleaned. While the specific configuration of the rake-like structure defining the agitating means 20 may vary, the plurality of tines 22 are formed from a sufficiently rigid material so as to effectively "work" the fibers or other material from which the carpet or rug surface 26 is formed. Such "working" serves to dislodge any encrusted or entrained dirt particles (or other material causing the stain) and also serves to "work" in and distribute any cleaning liquid dispersed directly on the spot or stain or the localized area attempting to be cleaned by the subject tool assembly 10.

To accomplish the latter, a preferred embodiment of the subject tool assembly 10 further comprises a liquid dispensing means generally indicated as 28. The liquid dispensing means may be removably secured to the exterior of the elongated base 12 or alternately may be mounted at least partially on the interior thereof when the base 12 has a substantially hollow interior configuration. In either embodiment, the dispensing means 28 includes a liquid supply container or reservoir 30 connected in fluid communication to a dispensing head 32 by means of appropriate conduit or tubing 34. A release or trigger mechanism generally indicated at 36 is mounted on the base 12 adjacent the one end corresponding to the location of the handle means 14. At this location, the release mechanism can be easily manipulated so as to allow release and/or forced dispensing of the liquid within the supply reservoir 30 to pass down through conduit 34 and exit the dispensing head 32 onto the preferred or designated area. Such force dispensing and operation of the release mechanism 36 can be accomplished by a connecting rod or shaft 38 or by utilizing in addition any of a wide variety of mechanisms well known in the dispensing art.

The tool assembly 10 also comprises a cleaning means generally indicated as 40 and mounted on the one end 16 of the base 12 adjacent the position of the agitating means 20. The cleaning means 40 comprises a cleaning head 42 and a connecting link or member 44 serving to movably interconnect the head 42 to the base and further causing its disposition to extend outwardly from the longitudinal axis of the base 12 in a direction which is variant to the outward extension or disposition of the agitating means 20 as clearly shown in FIG. 1.

Figure 3:
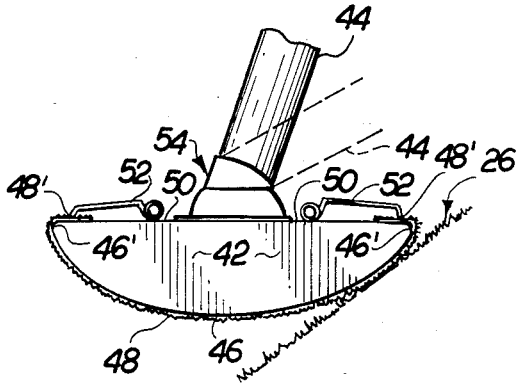
FIG. 3 is a sectional view through the cleaning head showing absorbent outer sheath mounted in covering relation on the support surface thereof.
Figure 2:
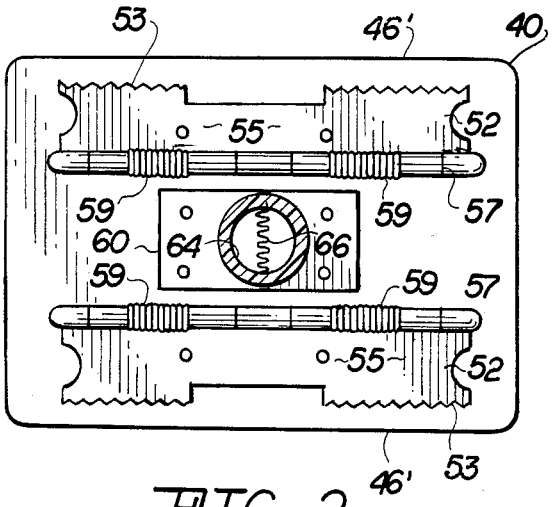
FIG. 2 is a top plan view in detail of a connecting assembly associated with the cleaning head structure of the present invention.

With reference to FIGS. 1, 2 and 3, the cleaning head 40 comprises a curvilinear or substantially arcuate supporting surface 46 on an outer face thereof and the support surface 46 is disposed to substantially confront the carpet, rug or like surface being cleaned 26. In order to effect the desired blotting or absorbing of excess cleaning fluid, a cover or sheath 48 is positioned in overlying and covering relation to the supporting surface 46 and is more specifically disposed to come into actual contact with the surface 26 being cleaned as well as any moisture thereon. The opposite ends of the absorbent sheath 48 are mounted on the upper face 50 of the support head 40 by means of mounting means in the form of two spaced apart spring biased mounting clips 52. Each of the clips 52 are disposed exteriorly or outboard of the supporting face 46 and specifically on the upper face 50 as clearly shown in FIGS. 2 and 3. Further, each of the clips 52 are positioned substantially adjacent to the outermost periphery or edges of the supporting surface 46 as at 46' so as to communicate and grippingly engage the opposite ends of the absorbent sheath as at 48'. The structure of the clips 52 may of course vary but they generally include a gripping edge 53 mounted on gripping plate 55 which is hingedly connected by a hinge structure 57 to the face 50. Biasing springs 59 may be provided as shown in connective relation to the hinge member 57 so as to normally bias the gripping plate 55 in a closed or gripping position as shown in FIG. 3. With regard to FIGS. 2 and 3, the desired blotting effect of the absorbent cover or sheath 48 is accomplished by manipulating the support head 40 into a rocking movement relative to the surface being cleaned 26. Such rocking movement is accomplished by a movable or pivotal connection generally indicated as 54 serving to interconnect the support rod or element 44 to the face 50 and is facilitated or made possible by the arcuate cross-sectional configuration of the supporting surface 46 extending continuously along the length thereof. Such pivotal connection includes a mounting plate 60 and a receiving aperture 64 formed therein. The actual movable interconnection may take a variety of structural configurations known in the art and may include a biasing spring 66 which serves to bias the support head 40 in a normal orientation as clearly shown in FIG. 1.

Another feature of the present invention to be included in the preferred embodiment thereof is the provision of a guide means generally indicated as 70 which may be considered as part of the handle means. The handle means 14 includes two spaced apart outwardly extending handle portions 15 and 17 and similarly, the guide means 70 includes two outwardly extending guide elements 72 and 74 extending outwardly in different directions from the length of the base 12 as clearly shown in FIG. 1. In operation, one of the handles 17 and one of the guide elements as at 72 are gripped to position the base in the position shown in FIG. 1. In such position, the agitating means 20 assumes a first operative position in that the tines 22 are in engagement with the surface 26 being cleaned. The cleaning fluid may be dispersed by operation of the release or trigger mechanism 36 onto the designated area. After the fluid is properly "worked" into the surface and/or any encrusted dirt material is dislodged therefrom, the opposite handle portion 15 and guide element 54 may be gripped by the hands of the user and the base 12 may be disposed in a reversed orientation such that the cleaning means 40 including the cleaning head 42 is disposed in operative engagement with the cleaning surface 26 as shown in FIG. 3. This may be defined as the second operative position of the base and the cleaning means 40 and such operative position, the opposite handle portion 15 and guide element 74 are gripped as indicated.

Proper rocking movement of the cleaning head 42 in a reciprocal manner is accomplished by manipulating the base and the head due to the movable or pivotal interconnection as at 54 between the supporting element 44 and the head itself 42. This accomplishes the desired "blotting" and the absorbing or any excess liquid maintained on the surface 26 being cleaned.

Now that the invention has been described, what is claimed is:

1. A cleaning tool assembly designed to clean and remove stains and the like from a carpet or like surface, said assembly comprising:

(a) a base having an elongated configuration and including a handle means mounted, at least partially, at one end thereof for manipulating said tool assembly, (b) an agitating means for working the surface being cleaned and secured to an opposite end of said base relative to said handle means and extending outwardly from said base, (c) a cleaning means for removing fluid from the surface being cleaned and secured to said base at said opposite end and extending outwardly from said base in a different direction than said agitating means, (d) said cleaning means comprising a support head and a fluid absorbing member secured to said support head and positionable in movable engagement with a surface being cleaned, (e) said support head pivotally secured to said base and including an elongated support surface reciprocally positionable and engageable with the surface being cleaned upon manipulation of said base and handle means, said support surface comprising a substantially arcuate cross-sectional configuration extending along its length, (f) said fluid absorbing member comprising a flexible absorbent material cover removably mounted in overlying, exposed and supporting engagement on said support surface, (g) said fluid absorbing member extending in covering and substantially conforming relation to said support surface and assuming the arcuate cross-sectional configuration thereof and including opposite ends thereof removably connected to said support head outboard in spaced relation to said support surface and being structured for removably connecting opposite ends of said absorbing member, and (h) said base and said handle means being cooperatively disposed and configured for reverse orientation relative to the surface being cleaned and positioning of said base being a first and a second operative position respectively defined by said agitating means and said cleaning means being disposed in operative engagement with the surface being cleaned.

2. An assembly as in claim 1 further comprising connecting means secured to said support head in spaced relation to said support surface and being structured for removably connecting opposite ends of said absorbing member.

3. An assembly as in claim 2 wherein said connecting means comprises two spaced apart connecting clips each mounted in spaced, adjacent relation to a different opposite end of said support surface and each connecting clip removably attachable to a different opposite end of said absorbing member.

4. An assembly as in claim 1 further comprising a liquid dispensing means mounted on said base and disposed and structured to dispense a cleaning liquid therefrom onto a designated portion of the surface being cleaned.

5. An assembly as in claim 4 wherein said liquid dispensing means comprises a dispensing head disposed substantially adjacent said opposite end of said base in communicating relation to the surface being cleaned.

6. An assembly as in claim 5 wherein said liquid dispensing means further comprises an actuating means connected to said base substantially adjacent said handle means and operable for releasing liquid from said dispensing head onto the surface being cleaned.

7. An assembly as in claim 1 wherein said handle means comprises oppositely disposed portions extending outwardly in substantially different directions from said base and alternately usable for positioning of said base in either said first or said second operative positions.

8. An assembly as in claim 7 wherein said handle means further comprises a guide structure mounted on said base in spaced relation to said one end thereof and disposed and structured to be used in cooperation with one of said handle portions for the manipulation of said base into one of said first or second operative positions.

9. An assembly as in claim 8 wherein said guide structure comprises two guide elements each extending outwardly from said base in a different direction and spaced in communicating relation to a remainder of said handle means mounted on said one end.

10. An assembly as in claim 9 wherein said handle means comprises two oppositely disposed handle portions extending outwardly in substantially opposite directions from said base and alternately usable for positioning of said base in either said first or said second operative positions, each guide element disposed in spaced relation to a different one of said handle portions and extending outwardly from said base in a substantially similar direction as to a corresponding one of said handle portions.

* * * * *